US009084062B2

(12) United States Patent
Endo et al.

(10) Patent No.: US 9,084,062 B2
(45) Date of Patent: Jul. 14, 2015

(54) CONVERSATION DETECTION APPARATUS, HEARING AID, AND CONVERSATION DETECTION METHOD

(75) Inventors: Mitsuru Endo, Tokyo (JP); Maki Yamada, Kanagawa (JP); Koichiro Mizushima, Kanagawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 583 days.

(21) Appl. No.: 13/386,939

(22) PCT Filed: Jun. 24, 2011

(86) PCT No.: PCT/JP2011/003617

§ 371 (c)(1),
(2), (4) Date: Jan. 25, 2012

(87) PCT Pub. No.: WO2012/001928

PCT Pub. Date: Jan. 5, 2012

(65) Prior Publication Data

US 2012/0128186 A1 May 24, 2012

(30) Foreign Application Priority Data

Jun. 30, 2010 (JP) ..... 2010-149435

(51) Int. Cl.

| | |
|---|---|
| ***H04R 3/00*** | (2006.01) |
| ***H04R 25/00*** | (2006.01) |
| *G10L 25/00* | (2013.01) |
| *G10L 21/06* | (2013.01) |
| *H04R 1/40* | (2006.01) |

(52) U.S. Cl.

CPC ..... *H04R 25/407* (2013.01); *G10L 25/00* (2013.01); *G10L 2021/065* (2013.01); *H04R 1/406* (2013.01); *H04R 2225/43* (2013.01)

(58) Field of Classification Search

CPC ..... H04R 2217/03; H04R 1/323; H04R 2499/15; H04R 5/02; H04R 2201/025; H04R 25/405; H04R 25/453; H04R 27/00; H04R 3/005; H04R 17/00; H04R 1/227; H04R 1/26; H04R 1/347; H04R 1/406; H04R 2201/401; H04R 2225/43; H04R 25/407

USPC ..... 381/313, 182, 92, 91, 94.1, 94.3, 94.7, 381/356, 387, 71.6, 71.8; 704/200, 205, 704/210, 211, 213, 226, 231, 233

See application file for complete search history.

(56) References Cited

U.S. PATENT DOCUMENTS

| | | | |
|---|---|---|---|
| 7,117,157 | B1 | 10/2006 | Taylor et al. |
| 2002/0041695 | A1 | 4/2002 | Luo |
| 2004/0081327 | A1 | 4/2004 | Jensen |
| 2004/0121790 | A1 | 6/2004 | Wolff et al. |
| 2008/0243494 | A1 | 10/2008 | Okamoto et al. |
| 2010/0111313 | A1 | 5/2010 | Namba et al. |
| 2011/0288860 | A1 * | 11/2011 | Schevciw et al. ..... 704/233 |

FOREIGN PATENT DOCUMENTS

| | | | |
|---|---|---|---|
| CN | 101740038 | | 6/2010 |
| JP | 2000-352996 | A | 12/2000 |
| JP | 2001-274912 | A | 10/2001 |
| JP | 2004-133403 | A | 4/2004 |
| JP | 2004-527177 | A1 | 9/2004 |
| JP | 2005-157086 | A | 6/2005 |
| JP | 2008-242318 | A | 10/2008 |
| JP | 2010-034812 | A | 2/2010 |
| WO | 02/085066 | A2 | 10/2002 |

OTHER PUBLICATIONS

International Search Report for PCT/JP2011/003617 dated Aug. 9, 2011.

Shoji Makino, et al., "Blind Source Separation based on Independent Component Analysis", The Institute of Electronics, Information and Communication Engineers Technical Report, EA, Engineering Acoustics 103 (129), 17-24, Jun. 13, 2003.

English language translation of Search Report issued with Office Action dated Jun. 5, 2014 in Chinese Application No. 201180003168.2.

* cited by examiner

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

A conversation detection apparatus uses a head-mounted microphone array to accurately determine whether a speaker in front is a conversing person or not. A conversation detection apparatus (100) includes a self-speech detection section (102) that detects a speech of a wearer of a microphone array (101), a front speech detection section (103) that detects a speech of a speaker in front of the microphone array wearer as a speech in front direction, a side speech detection section (104) that detects a speech of a speaker residing at at least one of right and left of the wearer as a side speech, a side direction conversation establishment degree deriving section (105) that calculates a conversation establishment degree between the speech of the wearer and the side speech, based on detection results of the speech of the wearer and the side speech, a front direction conversation detection section (106) that determines presence/absence of conversation in front direction based on a detection result of the front speech and a calculation result of the side direction conversation establishment degree, and an output sound control section (107) that controls directivity of speech heard by the hearing aid wearer, based on the determined presence/absence of conversation in front direction.

7 Claims, 11 Drawing Sheets

CONVERSATION DETECTION APPARATUS, HEARING AID, AND CONVERSATION DETECTION METHOD

TECHNICAL FIELD

The present invention relates to a conversation detection apparatus, a hearing aid, and a conversation detection method for detecting conversation with a conversing person (a person with whom a conversation is held) in a situation where there are a plurality of speakers therearound.

BACKGROUND ART

In recent years, a hearing aid is configured to be able to form a directivity of sensitivity from input signals given by a plurality of microphone units (for example, see Patent Literature 1). A sound source which a wearer wants to hear using the hearing aid is mainly the voice of a person with whom the wearer of the hearing aid is speaking. Therefore, the hearing aid is desired to perform control in synchronization with the function for detecting conversation in order to effectively use directivity processing.

Conventionally, a method for sensing the situation of conversation includes a method using a camera and a microphone (for example, see Patent Literature 2). An information processing apparatus described in Patent Literature 2 processes a video provided by a camera and estimates an eye gaze direction of a person. When a conversation is held, it is considered that a conversing person tends to reside in the eye gaze direction. However, it is necessary to add an image capturing device, and therefore, this approach is inappropriate for the purpose of the hearing aid.

On the other hand, a direction from which a voice is heard can be estimated with a plurality of microphones (microphone array), a conversing person can be extracted from this estimation result information at a conference. However, the speech has a property of spreading. For this reason, in a case where there are a plurality of conversation groups such as conversations in a coffee shop, it is difficult to distinguish between words spoken to the wearer and words spoken to persons other than the wearer by determining only the arriving direction. The arriving direction of the voice perceived by the person who receives the speech does not represent the direction of the face of the person who spoke the voice. Since this point is different from video input which allows direct estimation of the directions of the face and the eye gaze, the approach to the detection of the conversing person based on the sound input is difficult.

For example, a conventional conversing person detection apparatus based on sound input in view of existence of interference sound includes a speech signal processing apparatus described in Patent Literature 3. The speech signal processing apparatus described in Patent Literature 3 determines whether a conversation is held or not by separating sound sources by processing input signals from the microphone array and calculating the degree of establishment of conversation between two sound sources.

The speech signal processing apparatus described in Patent Literature 3 extracts an effective speech in which a conversation is established under an environment where a plurality of speech signals from a plurality of sound sources are input in a mixed manner. This speech signal processing apparatus performs numerical conversion from a time-series of speeches in view of the property that holding a conversation is as if "playing catch".

FIG. 1 is a figure illustrating a configuration of a speech signal processing apparatus described in Patent Literature 3.

As shown in FIG. 1, speech signal processing apparatus 10 includes microphone array 11, sound source separation section 12, speech detection sections 13, 14, and 15 for respective sound sources, conversation establishment degree calculation sections 16, 17, and 18 each given for two sound sources, and effective speech extraction section 19.

Sound source separation section 12 separates plurality of sound sources that are input from microphone arrays 11.

Speech detection sections 13, 14, and 15 determine presence of speech/absence of speech in each sound source.

Conversation establishment degree calculation sections 16, 17, and 18 calculate conversation establishment degrees each given for two sound sources.

Effective speech extraction section 19 extracts a speech having the highest conversation establishment degree as effective speech from the conversation establishment degree each given for two sound sources.

Known methods for separating sound sources include a method using ICA (Independent Component Analysis) and a method using ABF (Adaptive Beamformer). The principle of operation of both of them is known to be similar (for example, see Non-Patent Literature 1).

CITATION LIST

Patent Literature

Patent Literature 1
United States Patent No.2002/0041695 A1
Patent Literature 2
Japanese Patent Application Laid-Open No.2000-352996
Patent Literature 3
Japanese Patent Application Laid-Open No. 2004-133403

Non-Patent Literature

Non-Patent Literature 1
Shoji Makino, el al., "Blind Source Separation based on Independent Component Analysis", The Institute of Electronics, Information and Communication Engineers Technical Report. EA, Engineering Acoustics 103 (129), 17-24, 2003-06-13

SUMMARY OF INVENTION

Technical Problem

However, in this kind of conventional speech signal processing apparatus, the effectiveness of the conversation establishment degree is reduced, and there is a problem in that it is impossible to accurately determine whether a speaker in front is a conversing person or not. This is because, in a case of a wearable microphone array (head-mounted microphone array), both of the speech of the wearer who wears the microphone array and the speech of a conversing person residing in front of the wearer are radiated in the same (forward) direction from the perspective of the wearer. Therefore, the conventional speech signal processing apparatus has difficulty in separating these speeches.

For example, when a microphone array is constituted by totally four microphone units of a both-ear hearing aid having two microphone units for each ear, sound source separation processing can be executed on an ambient audio signal around the head portion of the wearer. However, when the sound sources are in the same direction, e.g., when the sound sources are the speech of the speaker residing in front of the wearer and the speech of the wearer himself/herself, it is difficult to separate the sound sources either with the ABF or the ICA. This affects the accuracy of determining the presence of speech/absence of speech of each sound source, and also affects the accuracy of determination as to whether a conversation is established based on the determination of the presence of speech/absence of speech of each sound source.

An object of the present invention is to provide a conversation detection apparatus, a hearing aid, and a conversation detection method using a head-mounted microphone array and capable of accurately determining whether a speaker in front is a conversing person or not.

Solution to Problem

A conversation detection apparatus according to the present invention is configured to include a microphone array having at least two or more microphones per one side attached to at least one of right and left sides of a head portion, the conversation detection apparatus using the microphone array to determine whether a speaker in front is a conversing person or not, the conversation detection apparatus including a front speech detection section that detects a speech of a speaker in front of the microphone array wearer as a speech in front direction, a self-speech detection section that detects a speech of the microphone array wearer, a side speech detection section that detects a speech of a speaker residing at at least one of right and left of the microphone array wearer as a side speech, a side direction conversation establishment degree deriving section that calculates a conversation establishment degree between the speech of the wearer and the side speech, based on detection results of the speech of the wearer and the side speech; and a front direction conversation detection section that determines presence/absence of conversation in front direction based on a detection result of the front speech and a calculation result of the side direction conversation establishment degree, wherein the front direction conversation detection section determines that conversation is held in front direction when the speech in front direction is detected and the conversation establishment degree in the side direction is less than a predetermined value.

The hearing aid according to the present invention is configured to include the above conversation detection apparatus and an output sound control section that controls directivity of sound to be heard by the microphone array wearer, based on the conversing person direction determined by the front direction conversation detection section.

A conversation detection method according to the present invention uses a microphone array having at least two or more microphones per one side attached to at least one of right and left sides of a head portion to determine whether a speaker in front is a conversing person or not, the conversation detection method including the steps of detecting a speech of a speaker in front of the microphone array wearer as a speech in front direction, detecting a speech of the microphone array wearer, detecting a speech of a speaker residing at at least one of right and left of the microphone array wearer as a side speech, calculating a conversation establishment degree between the speech of the wearer and the side speech, based on detection results of the speech of the wearer and the side speech, and a front direction conversation detection step, in which presence/absence of conversation in front direction is determined based on a detection result of the front speech and a calculation result of the side direction conversation establishment degree, wherein in the front direction conversation detection step, it is determined that conversation is held in front direction when the speech in front direction is detected and the conversation establishment degree in the side direction is less than a predetermined value.

Advantageous Effects of Invention

According to the present invention, presence/absence of a speech in a front direction can be detected without using a result of calculation of conversation establishment degree in front direction which is likely to be affected by a speech of a wearer. As a result, conversation in the front direction can be detected accurately without being affected by the speech of the wearer, and a determination can be made as to whether the speaker in front is a conversing person or not.

DESCRIPTION OF EMBODIMENTS

Embodiments of the present invention will be hereinafter explained in detail with reference to the drawings.

(Embodiment 1)

Figure 1:
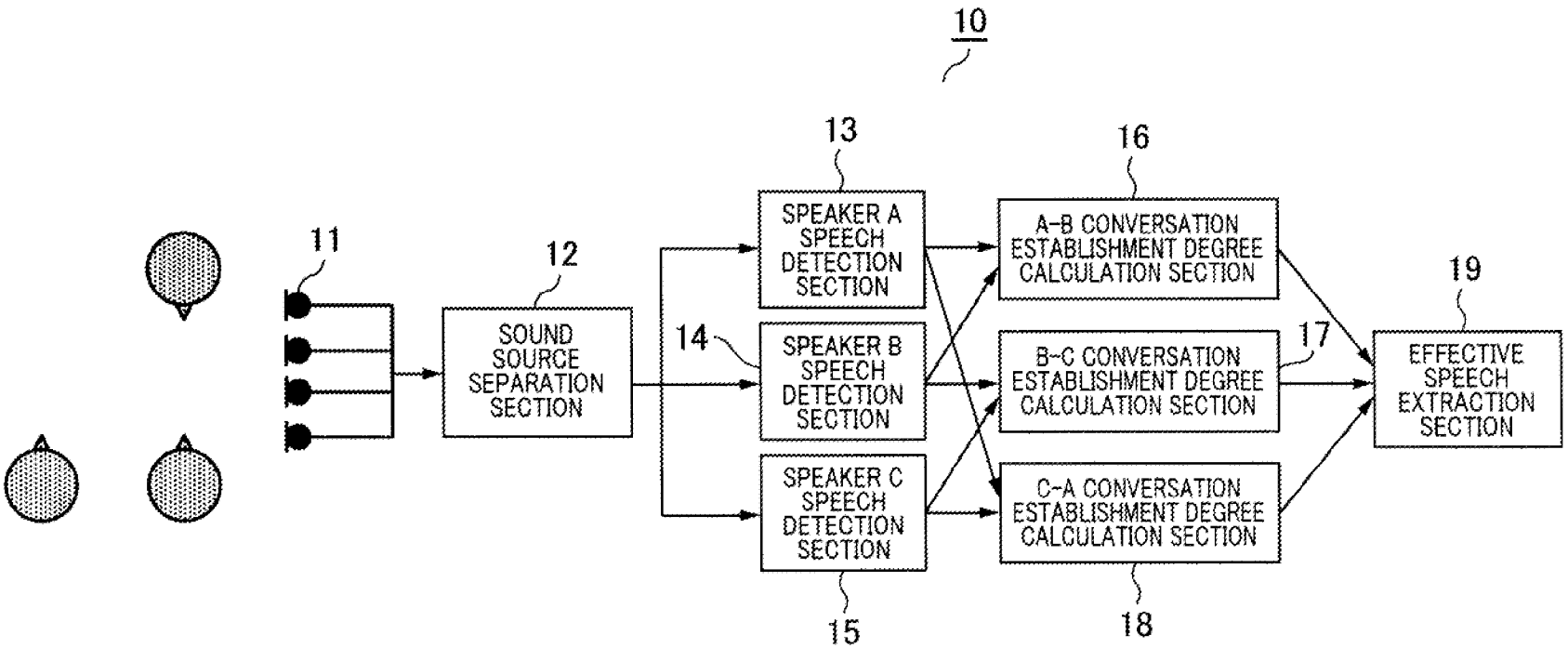
PRIOR ART FIG. 1
FIG. 1 is a figure illustrating a configuration of a conventional speech signal processing apparatus.
Figure 2:
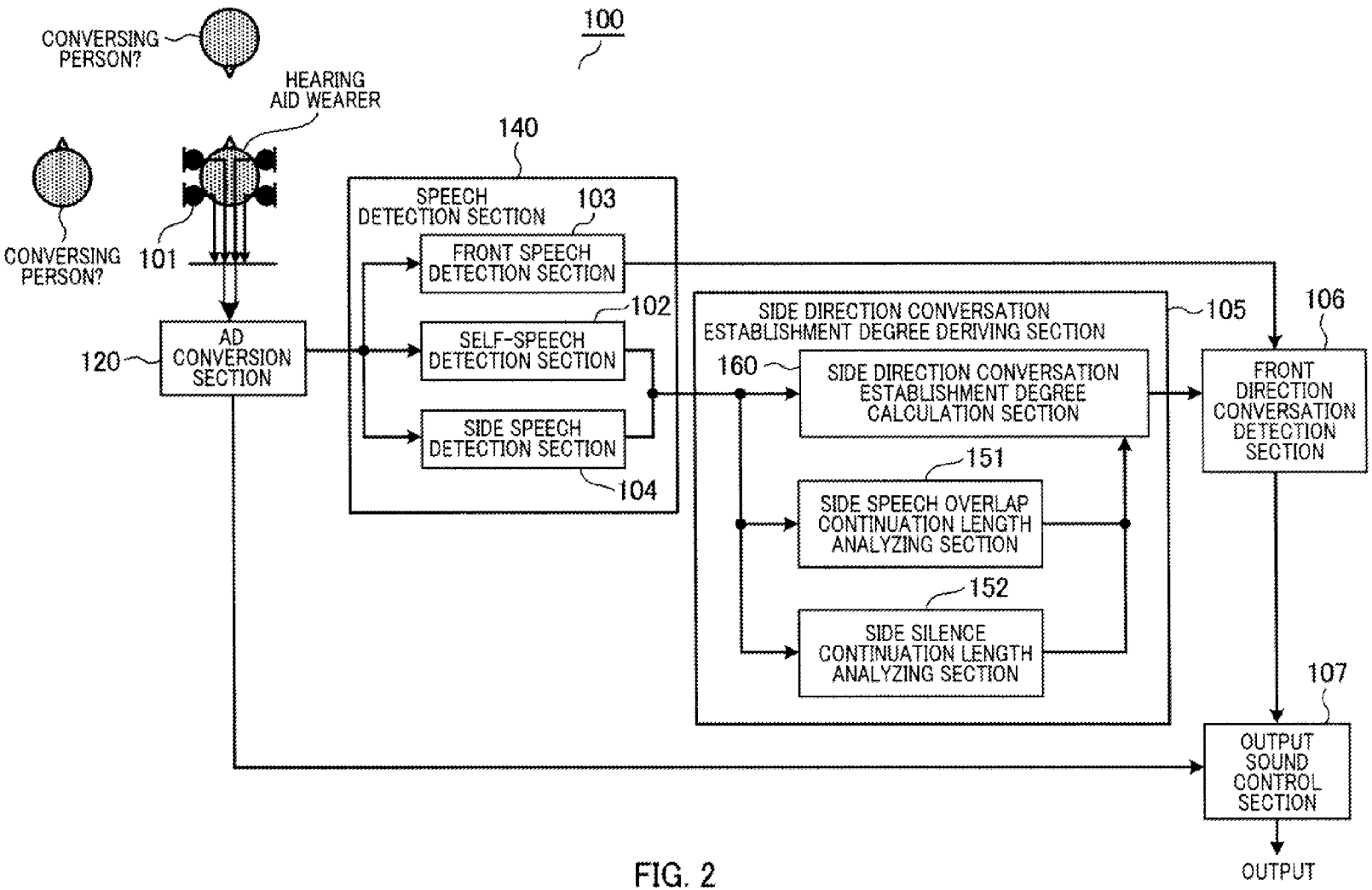
FIG. 2 is a figure illustrating a configuration of a conversation detection apparatus according to Embodiment 1 of the present invention.

FIG. 2 is a figure illustrating a configuration of a conversation detection apparatus according to Embodiment 1 of the present invention. The conversation detection apparatus of the present embodiment can be applied to a hearing aid having an output sound control section (directivity control section).

As shown in FIG. 2, conversation detection apparatus 100 includes microphone array 101, A/D (Analog to Digital) conversion section 120, speech detection section 140, side direction conversation establishment degree deriving section (side direction conversation establishment degree calculation section) 105, front direction conversation detection section 106, and output sound control section (directivity control section) 107.

Microphone array 101 is constituted by totally four microphone units with two microphone units provided on each of the right and left ears. The distance between microphone units at one of the ears is about 1 cm. The distance between right and left microphone units is about 15 to 20 cm.

A/D conversion section 120 converts a speech signal provided by microphone array 101 into a digital signal. Then, A/D conversion section 120 outputs the converted speech signal to self-speech detection section 102, front speech detection section 103, side speech detection section 104, and output sound control section 107.

In speech detection section 140, side speech detection section 104 receives 4-channel audio signal from microphone array 101 (signal that has been converted by A/D conversion section 120 into digital signal). Then, speech detection section 140 respectively detects, from this audio signal, a speech of the wearer of microphone array 101 (hereinafter referred to as hearing aid wearer), a speech in front direction, and a speech in side direction. Speech detection section 140 includes self-speech detection section 102, front speech detection section 103, and side speech detection section 104.

Self-speech detection section 102 detects the speech of the wearer who wears the hearing aid. Self-speech detection section 102 detects the speech of the wearer by using extraction of a vibration component. More specifically, self-speech detection section 102 receives the audio signal. Then, self-speech detection section 102 successively determines presence/absence of the speech of the wearer from the wearer speech power component obtained by extracting noncorrelated signal component between front and back microphones. The extraction of noncorrelated signal component can be achieved using a low pass filter and subtraction-type microphone array processing.

Front speech detection section 103 detects the speech of the speaker in front of the hearing aid wearer as a speech in front direction. More specifically, front speech detection section 103 receives a 4-channel audio signal from microphone array 101. Then, front speech detection section 103 forms directivity in front, and successively determines presence/absence of the speech in front from the power information. Self-speech detection section 102 may divide this power information by the value of the wearer speech power component obtained from self-speech detection section 102 in order to reduce the effect of the speech of the wearer.

Side speech detection section 104 detects the speech of at least one of right and left of the hearing aid wearer as a side speech. More specifically, side speech detection section 104 receives 4-channel audio signal from microphone array 101. Then, side speech detection section 104 forms directivity in side direction, and successively determines presence/absence of the speech in side direction from this power information. Side speech detection section 104 may divide this power information by the value of the wearer speech power component obtained from self-speech detection section 102 in order to reduce the effect of the speech of the wearer. Side speech detection section 104 may also use power difference between right and left in order to increase the degree of separation between the speech of the wearer and the speech in front direction.

Side direction conversation establishment degree deriving section 105 calculates a conversation establishment degree between the speech of the wearer and the side speech, based on the detection result of the speech of the wearer and the side speech. More specifically, side direction conversation establishment degree deriving section 105 obtains the output of self-speech detection section 102 and the output of side speech detection section 104. Then, side direction conversation establishment degree deriving section 105 calculates a side direction conversation establishment degree from time-series of presence/absence of the speech of the wearer and the side speech. In this case, the side direction conversation establishment degree is a value representing the degree at which conversation is held between the hearing aid wearer and the speaker in side direction thereof.

Side direction conversation establishment degree deriving section 105 includes side speech overlap continuation length analyzing section 151, side silence continuation length analyzing section 152, and side direction conversation establishment degree calculation section 160.

Side speech overlap continuation length analyzing section 151 obtains and analyzes the continuation length of a speech overlap section (hereinafter referred as "speech overlap continuation length analytical value") between the speech of the wearer detected by self-speech detection section 102 and the side speech detected by side speech detection section 104.

Side silence continuation length analyzing section 152 obtains and analyzes the continuation length of a silence section (hereinafter referred to as "silence continuation length analytical value") between the speech of the wearer detected by self-speech detection section 102 and the side speech detected by side speech detection section 104.

That is, side speech overlap continuation length analyzing section 151 and side silence continuation length analyzing section 152 extracts a speech overlap continuation length analytical value and a silence continuation length analytical value as discriminating parameters representing feature quantities of everyday conversation. The discriminating parameter determines (discriminates) a conversing person, and is used to calculate the conversation establishment degree. It should be noted that a method for calculating the speech overlap analytical value and the silence analytical value in the discriminating parameter extraction section 150 will be explained later.

Side direction conversation establishment degree calculation section 160 calculates a side direction conversation establishment degree, based on the speech overlap continuation length analytical value calculated by side speech overlap continuation length analyzing section 151 and the silence continuation length analytical value calculated by side silence continuation length analyzing section 152. A method for calculating the side direction conversation establishment degree in side direction conversation establishment degree calculation section 160 will be explained later.

Front direction conversation detection section 106 detects presence/absence of the conversation in front direction, based on the detection result of the front speech and the calculation result of the side direction conversation establishment degree. More specifically, front direction conversation detection section 106 receives the output of front speech detection section 103 and the output of side direction conversation establishment degree deriving section 105, and determines presence/absence of the conversation between the hearing aid wearer and the speaker in front direction by comparison in magnitude with a threshold value set in advance. Further, when the speech in front direction is detected, and the conversation establishment degree in side direction is low, front direction conversation detection section 106 determines whether a conversation is held in front direction.

In this manner, front direction conversation detection section 106 has a function of detecting presence/absence of the speech in front direction and a conversing person direction determining function for determining that a conversation is held in front direction when the speech in front direction is detected and the conversation establishment degree in side direction is low. From such point of view, front direction conversation detection section 106 may be called a conversation state determination section. Front direction conversation detection section 106 may be constituted by this conversation state determination section as a separate block.

Output sound control section 107 controls the directivity of the speech to be heard by the hearing aid wearer, based on the conversation state determined by front direction conversation detection section 106. In other words, output sound control section 107 controls and outputs the output sound so that the voice of the conversing person determined by front direction conversation detection section 106 can be heard easily. More specifically, output sound control section 107 performs directivity control on the speech signal received from A/D conversion section 120 so as to suppress a sound source direction of a non-conversing person.

A CPU executes detection, calculation, and control of each of the above blocks. Instead of causing the CPU to perform all the processings, a DSP (Digital Signal Processor) for processing some of the signals may be used.

Operation of conversation detection apparatus 100 configured as described above will be hereinafter explained.

Figure 3:
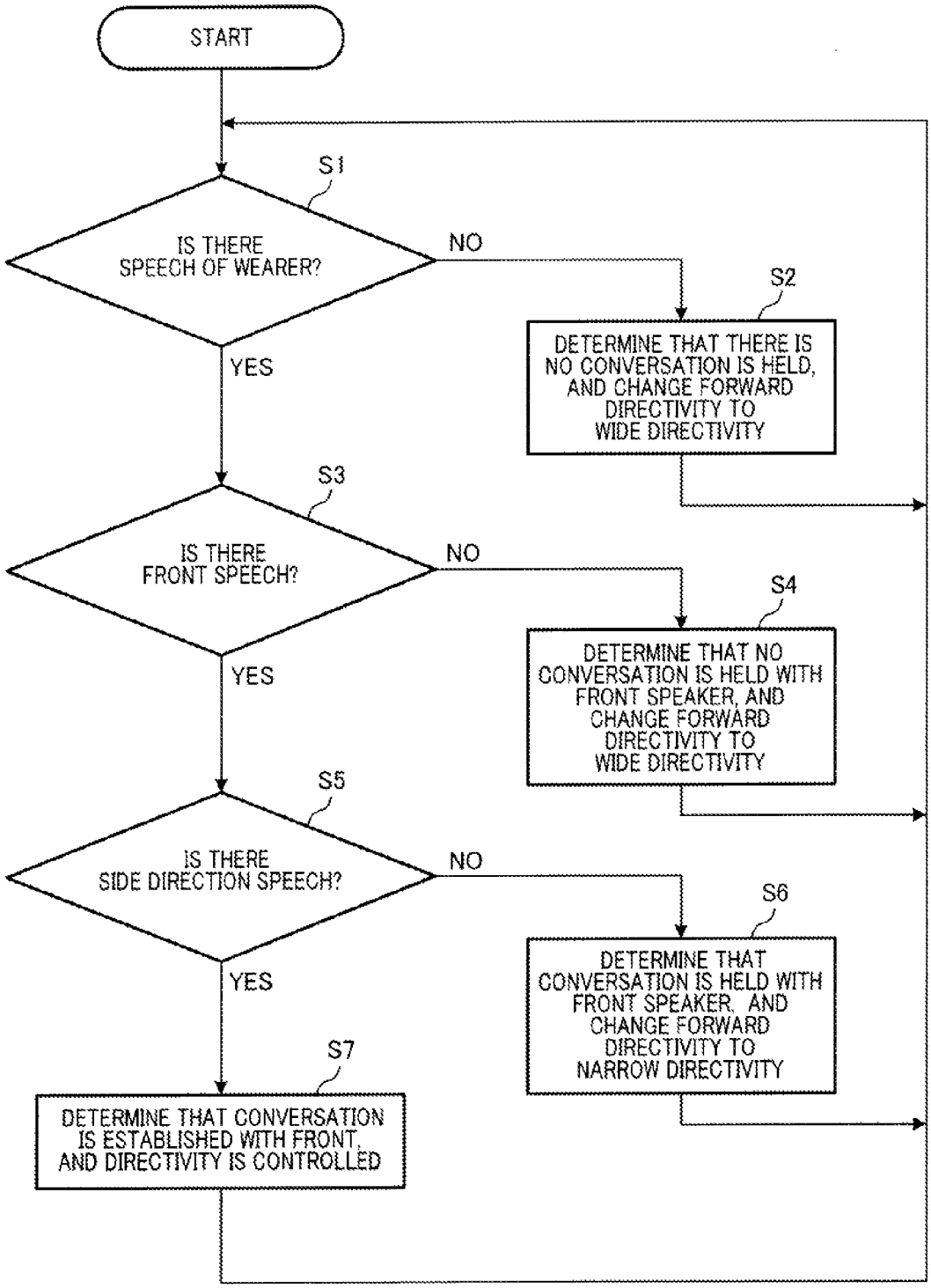
FIG. 3 is a flow diagram illustrating directivity control and state determination of conversation in the conversation detection apparatus according to Embodiment 1 above.

FIG. 3 is a flow chart illustrating the directivity control and the state determination of conversation in conversation detection apparatus 100. This flow is executed by the CPU with predetermined timing. S in the figure denoting each step of the flow.

When this flow starts, self-speech detection section 102 detects presence/absence of the speech of the wearer in step S1. When there is no speech spoken by the wearer (S1: NO), step S2 is subsequently performed. When there is a speech spoken by the wearer (S1: YES), step S3 is subsequently performed.

In step S2, front direction conversation detection section 106 determines that the hearing aid wearer is not having conversation because there is no speech spoken by the wearer. Output sound control section 107 sets the directivity in front direction to wide directivity according to the determination result indicating that the hearing aid wearer is not having conversation.

In step S3, front speech detection section 103 detects presence/absence of the front speech. When there is no front speech (S3: NO), step S4 is subsequently performed. When there is front speech (S3: YES), step S5 is subsequently performed. When there is front speech, the hearing aid wearer and the speaker in front direction may be having conversation.

In step S4, front direction conversation detection section 106 determines that the hearing aid wearer is not having conversation with the speaker in front because there is no front speech. Output sound control section 107 sets the directivity in front direction to wide directivity according to the determination result indicating that the hearing aid wearer is not having conversation with the speaker in front.

In step S5, side speech detection section 104 detects presence/absence of the side speech. When there is no side speech (S5: NO), step S6 is subsequently performed. When there is side speech (S5: YES), step S7 is subsequently performed.

In step S6, front direction conversation detection section 106 determines that the hearing aid wearer is having conversation with the speaker in front because there are the speech of the wearer and the front speech but there is no side speech. Output sound control section 107 sets the directivity in front direction to narrow directivity according to the determination result indicating that the hearing aid wearer is having conversation with the speaker in front.

In step S7, front direction conversation detection section 106 determines whether the hearing aid wearer is having conversation with the speaker in front direction, based on the output of side direction conversation establishment degree deriving section 105. Output sound control section 107 switches the directivity in front direction to narrow directivity and wide directivity according to the determination result indicating that the hearing aid wearer is having conversation with the speaker in front direction.

It should be noted that the output of side direction conversation establishment degree deriving section 105 received by front direction conversation detection section 106 is the side direction conversation establishment degree calculated by side direction conversation establishment degree deriving section 105 as described above. In this case, operation of side direction conversation establishment degree deriving section 105 will be explained.

Side speech overlap continuation length analyzing section 151 and side silence continuation length analyzing section 152 of side direction conversation establishment degree deriving section 105 obtain a continuation length of a silence section and speech overlap between a speech signal S1 and a speech signal Sk.

In this case, the speech signal S1 is a user voice and the speech signal Sk is speech arriving from side direction k.

Then, side speech overlap continuation length analyzing section 151 and side silence continuation length analyzing section 152 respectively calculate speech overlap analytical value Pc and silence analytical value Ps of frame t, and outputs them to side direction conversation establishment degree calculation section 160.

Subsequently, a method for calculating speech overlap analytical value Pc and silence analytical value Ps will be explained. First, a method for calculating speech overlap analytical value Pc will be explained with reference to FIGS. 4A to 4C.

Figures 4A, 4B, 4C:
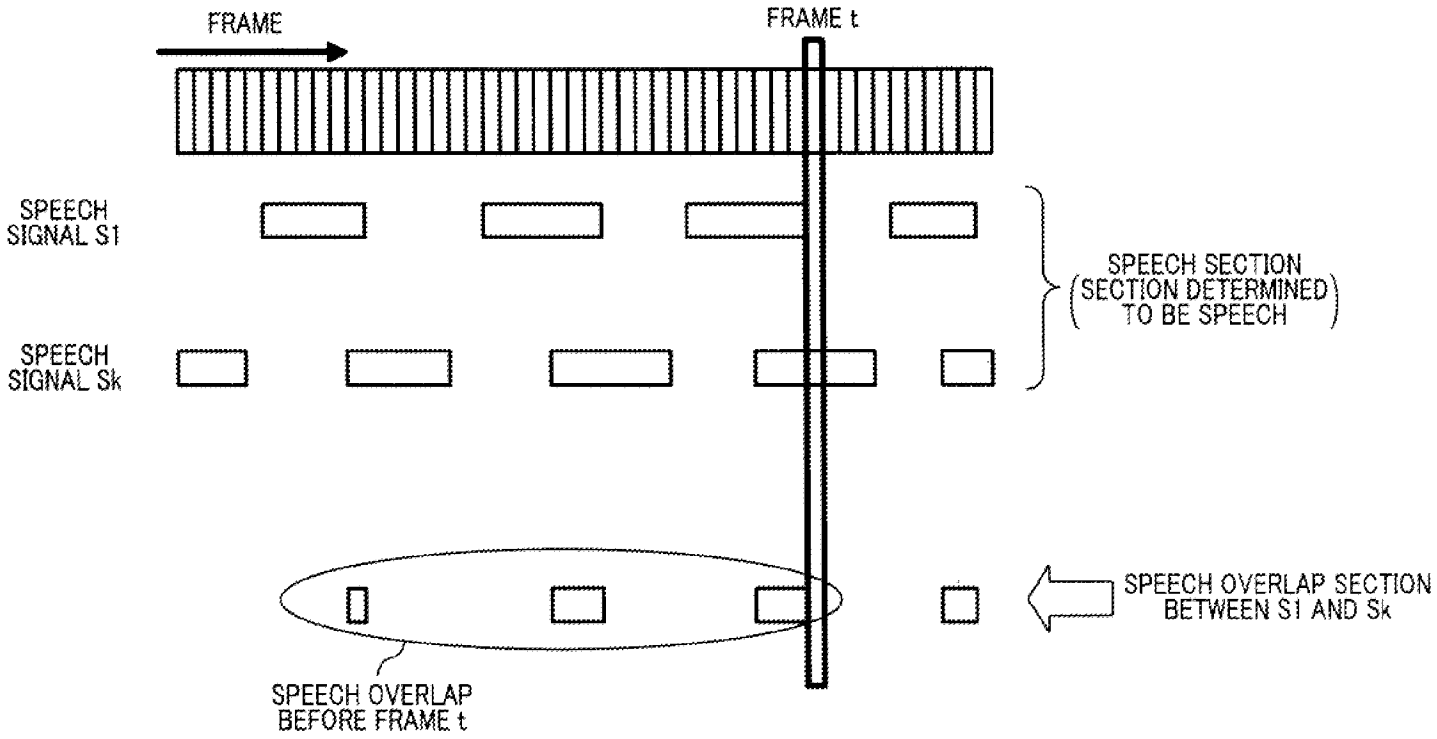
FIGS. 4A to 4C are figures illustrating a method for obtaining a speech overlap analytical value Pc.

In FIG. 4A, a section denoted with a rectangle represents a speech section in which the speech signal S1 is determined to be a speech, based on speech section information representing speech/non-speech detection result generated by self-speech detection section 102. In FIG. 4B, a section denoted with a rectangle represents a. speech section in which side speech detection section 104 determines that the speech signal Sk is a speech. Then, side speech overlap continuation length analyzing section 151 defines a portion where these sections overlap each other as a speech overlap (FIG. 4C).

Specific operation in side speech overlap continuation length analyzing section 151 is as follows. In frame t, when the speech overlap starts, side speech overlap continuation length analyzing section 151 memorizes the frame as a start edge frame. Then, at frame t, when the speech overlap ends, side speech overlap continuation length analyzing section 151 deems this as one speech overlap, and adopts a time length from the start edge frame as a continuation length of the speech overlap.

In FIG. 4C, a portion enclosed by an ellipse represents a speech overlap before the frame t. Then, in frame t, when the speech overlap ends, side speech overlap continuation length analyzing section 151 obtains and stores a statistics value about the continuation length of the speech overlap before frame t. Further, side speech overlap continuation length analyzing section 151 uses this statistics value to calculate speech overlap analytical value Pc at frame t. Speech overlap analytical value Pc is desirably a parameter indicating whether there are many short continuation lengths or many long continuation lengths.

Subsequently, a method for calculating silence analytical value Ps will be explained.

First, in the present embodiment, based on the speech section information generated by self-speech detection section 102 and side speech detection section 104, a portion in which a section where the speech signal S1 is determined to be a non-speech and a section where the speech signal Sk is determined to be a non-speech overlap each other is defined as silence. Like the analysis degree of the speech overlap, side silence continuation length analyzing section 152 obtains the continuation length of the silence section, and obtains and stores the statistics value about the continuation length of the silence section before frame t. Further, side silence continuation length analyzing section 152 uses this statistics value to calculate silence analytical value Ps at frame t. Silence analytical value Ps is desirably a parameter indicating whether there are many short continuation lengths or many long continuation lengths.

Subsequently, a specific method for calculating speech overlap analytical value Pc and silence analytical value Ps will be explained.

Side silence continuation length analyzing section 152 respectively memorizes/updates the statistics value about the continuation length at frame t. The statistics value about the continuation length includes (1) a summation Wc of continuation lengths of speech overlaps, (2) the number of speech overlaps Nc, (3) a summation Ws of continuation lengths of silences, and (4) the number of silences Ns, which are before frame t. Then, side speech overlap continuation length analyzing section 151 and side silence continuation length analyzing section 152 respectively obtain an average continuation length Ac of speech overlaps before frame t and an average continuation length As of silence sections before frame t using equations 1-1 and 1-2.

[1]

Ac=summation Wc of continuation lengths of speech overlaps/the number of speech overlaps Nc (Equation 1-1)

As=summation Ws of continuation lengths of silence sections/the number of silences Ns (Equation 1-2)

When the values of Ac and As are smaller, this indicates that there are more short speech overlaps and short silences, respectively. Therefore, speech overlap analytical value Pc and silence analytical value Ps are defined as equations 2-1 and 2-2 below by reversing the signs of Ac and As so that they are consistent in the relationship of magnitude.

[2]

$$Pc=-Ac \quad \text{(Equation 2-1)}$$

$$Ps=-As \quad \text{(Equation 2-2)}$$

It should be noted that, besides speech overlap analytical value

Pc and silence analytical value Ps, the following parameter may be considered as a parameter indicating whether there are many conversations of which continuation length is short or many conversations of which continuation length is long.

The parameters are calculated by dividing conversations into conversations of which continuation length of speech overlap and silence is shorter than a threshold value T (for example, T=1 second) and conversations of which continuation length is equal to or longer than T, and obtaining the number of conversations in each of them or a summation of the continuation lengths. Subsequently, the parameter is calculated by obtaining a ratio with respect to the number of conversations or a summation of continuation lengths of which continuation length is short appearing before frame t. Then, this ratio serves as a parameter indicating that there are many conversations of which continuation length is short when the value of the parameter is large.

It should be noted that these statistics values are initialized when a silence continues for a certain period of time continues, so that they represent a set of properties of one conversation. Alternatively, the statistics values may be initialized with a regular time interval (for example, 20 seconds). The statistics values may constantly use statistics values of continuation lengths of speech overlaps and silences within a certain time window in the past.

Then, side direction conversation establishment degree calculation section 160 calculates a conversation establishment degree between the speech signal S1 and the speech signal Sk, and outputs the conversation establishment degree as a side direction conversation establishment degree to conversing person determination section 170.

Conversation establishment degree C1 , k(t) at frame t is defined as shown in, for example, equation 3.

[3]

$$C_{1,k}(t)=w1\cdot Pc(t)=w2\cdot Ps(t) \quad \text{(Equation 3)}$$

It should be noted that an optimal value of weight w1 of speech overlap analytical value Pc and an optimal value of weight w2 of silence analytical value Ps are obtained in advance through experiment.

Frame t is initialized when there has been no speech for a certain period of time from sound sources in all directions. Then, side direction conversation establishment degree calculation section 160 starts counting when there is power in a sound source in any direction. It should be noted that the conversation establishment degree may be obtained using a time constant for adapting to the latest situation by discarding data of distant past.

When no speech is detected in a side direction for a certain period of time, no person is considered to be present in side direction, and in such case, side speech overlap continuation length analyzing section 151 and side silence continuation length analyzing section 152 may not perform the above processing until speech is subsequently detected in order to reduce the amount of calculation. In this case, side direction conversation establishment degree calculation section 160 may output, for example, the conversation establishment degree C1, k(t)=0 to front direction conversation detection section 106.

Operation of side direction conversation establishment degree deriving section 105 has been hereinabove explained. It should be noted that a method for deriving side direction conversation establishment degree is not limited to the above content. Side direction conversation establishment degree deriving section 105 may calculate a conversation establishment degree according to a method described in Patent Literature 3, for example.

In this case, in step S5, when there is side speech, there are all of the speech of the wearer, the front speech, and the side speech. Accordingly, front direction conversation detection section 106 closely determines the situation of the conversation, and output sound control section 107 controls the directivity according to the result.

In general, when seen from the hearing aid wearer, the conversing person appears to be in front direction. However, when sitting at a table, a conversing person may be in side direction, and at that occasion, if the body of the conversing person faces the front because, e.g., the seat is fixed or the conversing person is having dinner, conversation is held while hearing the voice in side or obliquely side direction without seeing each other's face. The conversing person is at the back only in a very limited situation, e.g., sitting on a wheel chair. Therefore, the position of the conversing person seen from the hearing aid wearer can be usually divided into a front direction and a side direction which allow certain amounts of widths.

On the other hand, in microphone array 101 provided on, e.g., behind-the-ear hearing aid, the distance between right and left microphone units is about 15 to 20 cm, and the distance between front and back microphone units is about 1 cm. Therefore, due to frequency characteristics of beam forming, the directivity pattern of the speech band can be made sharp in front direction but cannot be made sharp in side direction. For this reason, when the control is limited to narrow or widen the directivity in front direction, it is considered that the hearing aid may only determine whether there is a conversing person in front, and even when there are speakers in front and at side, the hearing aid may determine establishment of conversation only with the speaker in front.

On the other hand, however, a different conclusion is derived in terms of detection of speeches needed for determining establishment of conversation. Even though the wearer wants to hear the voice of the conversing person with the hearing aid, the conversation also involves the speech of the hearing aid wearer. This speech of the wearer is radiated forward from the mouth of the hearing aid wearer, and this becomes a sound source in the same direction as the speech of the speaker in front, i.e., the speech of the wearer is present in a mixed manner within a beam former facing the front direction. Therefore, the speech of the wearer becomes an obstacle when the speech of the speaker in front is detected.

On the other hand, the radiation power of the speech of the wearer is reduced in side direction. Therefore, the detection of the speech of the speaker in side direction using the beam former is more advantageous than the front speech detection because the speech of the speaker in side direction is less affected by the speech of the wearer. In the establishment of the conversation, it can be estimated that unless conversation is established in side direction, the wearer is having conversation in front direction. Therefore, in a situation where there are speakers in front and at side, a determination as to whether the directivity in front direction is to be narrowed or not can be made more advantageously by adopting elimination method for choosing from among the positions of the conversing persons roughly divided into front and side under the above estimation, rather than by directly determining the chance of establishment of conversation in front direction.

Based on such consideration, front direction conversation detection section 106 detects presence/absence of conversation in front direction, based on the detection result of the front speech and the calculation result of the side direction conversation establishment degree. Then, front direction conversation detection section 106 detects the speech in front direction, and when the conversation establishment degree in side direction is low, a determination is made as to whether conversation is held in front direction. In other words, based on the assumption that the front speech is detected as the output of front speech detection section 103, front direction conversation detection section 106 determines that there is conversation between the hearing aid wearer and the speaker in front direction when the conversation establishment degree in side direction is low.

According to such configuration, front direction conversation detection section 106 determines that there is conversation between the hearing aid wearer and the speaker in front direction when the conversation establishment degree in side direction is low. Therefore, front direction conversation detection section 106 can detect conversation in front direction without using the conversation establishment degree in front direction in which high level of accuracy cannot be obtained due to the influence of the speech of the wearer.

The inventors of the present application actually recorded everyday conversation and conducted evaluation experiment of conversation detection. A result of this evaluation experiment will be hereinafter explained.

Figure 5B:
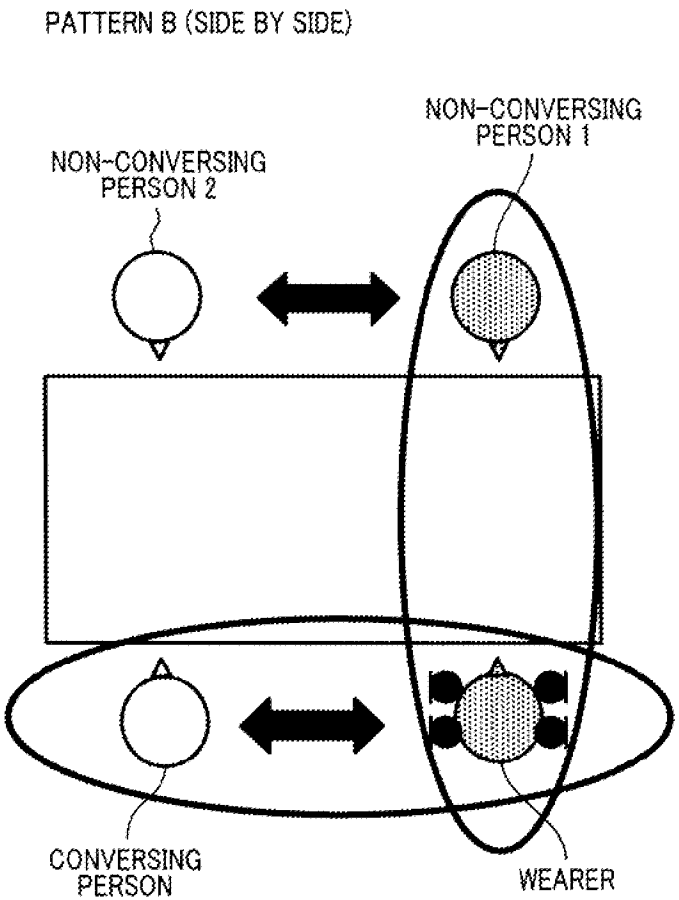
FIGS. 5A and 5B are figures illustrating an example of a speaker arrangement pattern of the conversation detection apparatus according to Embodiment 1 above where there are a plurality of conversation groups.
Figure 5A:
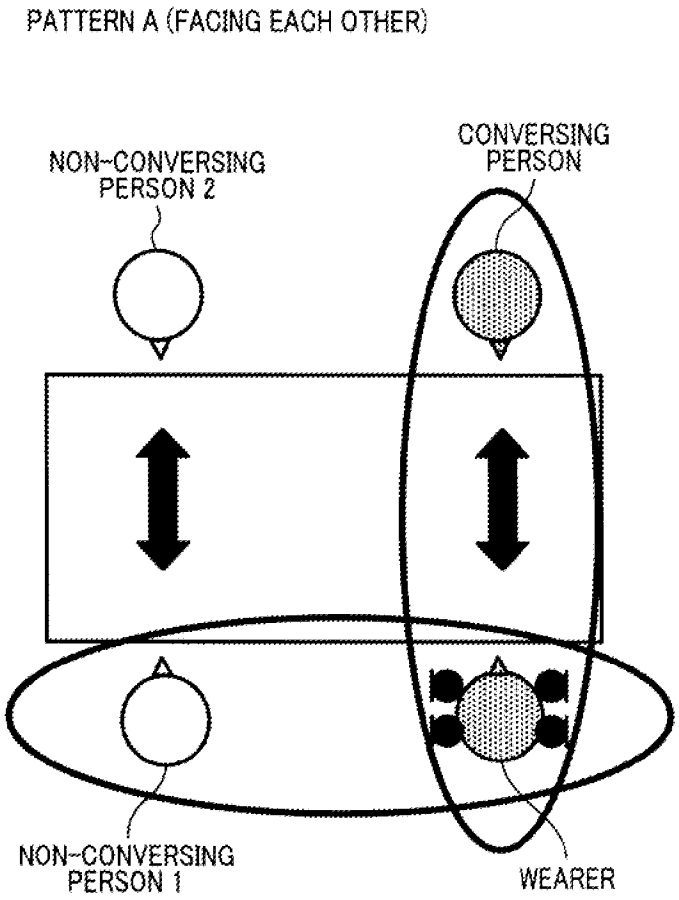

FIGS. 5A and 5B are figures illustrating an example of a speaker arrangement pattern where there are a plurality of conversation groups. FIG. 5A shows a pattern A in which the hearing aid wearer faces a conversing person. FIG. 5B shows a pattern B in which the hearing aid wearer and the conversing person are arranged side by side.

The amount of data is 10 minutes×2-seat arrangement pattern×2 speaker set. As shown in FIGS. 5A and 5B, the seat arrangement patterns include two patterns, i.e., the pattern A in which conversing persons face each other and the pattern B in which conversing person are side by side. Then, in this evaluation experiment, conversations are recorded in these two kinds of seat arrangement patterns. In the figure, the arrow represents a speaker pair having conversation. In this evaluation experiment, a conversation group including two persons has conversation at the same time. In this case, voices other than the voice of the conversing person with whom the wearer is speaking becomes interference sound, and therefore, examinees stated impression that the speech is noisy and it is difficult to talk. In this evaluation experiment, in the figure, a conversation establishment degree based on speech detection result is obtained for each speaker pair indicated by an ellipse, and the conversation is detected.

Equation 4 shows an expression for obtaining a conversation establishment degree of each speaker pair of which establishment of conversation is verified.

$$\text{Conversation establishment degree } C1 = C0 - wv \times \text{avelen_}DV - ws \times \text{avelen_}DU \quad \text{(Equation 4)}$$

In this case, C0 in the above equation 4 is an arithmetic expression of a conversation establishment degree disclosed in Patent Literature 3. The numerical value of C0 increases when each person in the speaker pair speaks, and decreases when the two persons speak at the same time or when the two persons become silent at the same time. On the other hand, avelen_DV denotes an average value of a length of simultaneous speech section of the speaker pair, and avelen_DU denotes an average value of a length of simultaneous silence section of the speaker pair. The following finding is used for avelen_DV and avelen_DU: expected values of the simultaneous speech section and the simultaneous silence section with a conversing person are short. The variables wv and ws denote weights, which are optimized through experiment.

Figure 6A:
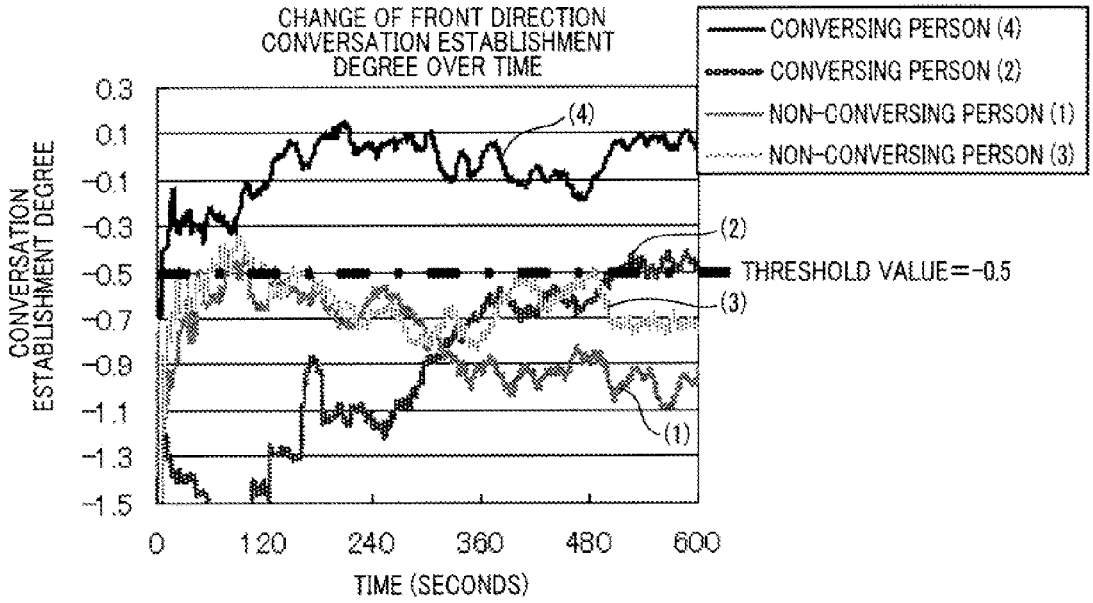
FIGS. 6A and 6B are figures illustrating an example of change of a conversation establishment degree over time in the conversation detection apparatus according to Embodiment 1 above.
Figure 6B:
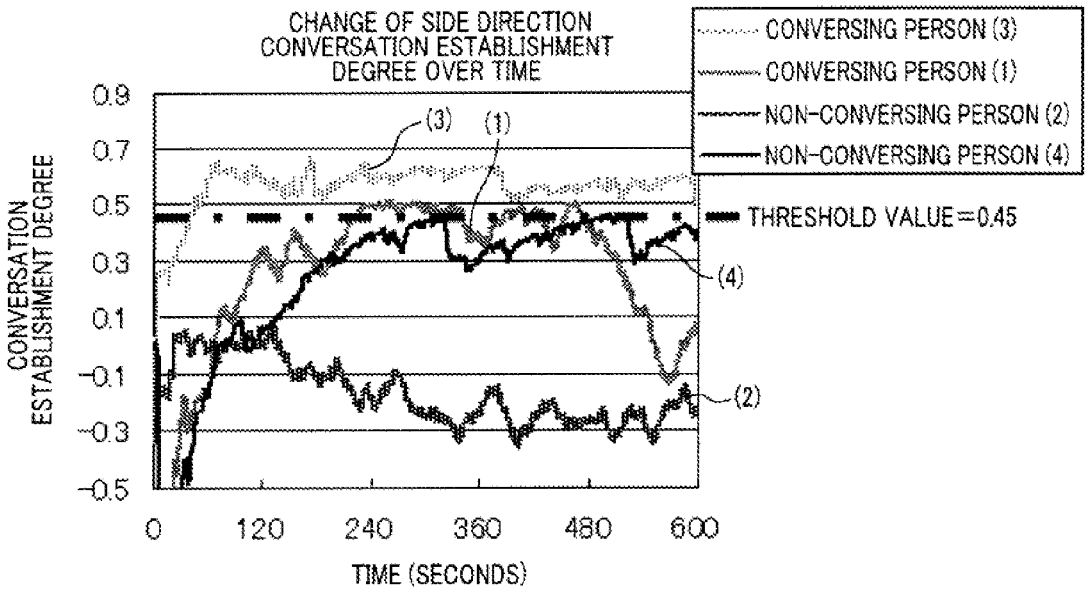

FIGS. 6A and 6B are figures illustrating an example of change of a conversation establishment degree over time in this evaluation experiment. FIG. 6A is a conversation establishment degree in front direction. FIG. 6B is a conversation establishment degree in side direction.

In both of FIGS. 6A and 6B, data in (1) and (3) are obtained when conversation is held side by side, and data in (2) and (4) are obtained when conversation is held face to face.

In FIG. 6A, a threshold value θ is set so as to divide a case where the speaker in front is a conversing person (see (2) and (4)) and a case where the front speaker in front is a non-conversing person (see (1) and (3)). In this example, when θ is set at −0.5, the cases can be divided relatively well, but in the above case (2), the conversation establishment degree does not increase, which makes it difficult to separate a conversing person and a non-conversing person.

In FIG. 6B, a threshold value θ is set so as to divide a case where the speaker at side is a conversing person (see (1) and (3)) and a case where the speaker at side is a non-conversing person (see (2) and (4)). In this example, when θ is set at 0.45, the cases can be divided relatively well. When FIGS. 6A and 6B are compared, the separation with the threshold value can be better separated in the case of FIG. 6B.

The criteria of the evaluation is as follows. In a case of a combination of conversing persons, the determination is made as correct when the value is more than the threshold value θ. In a case of a combination of non-conversing persons, the determination is made as correct when the value is less than the threshold value θ. On the other hand, the conversation detection accuracy rate is defined as an average value of a ratio of correctly detecting a conversing person and a ratio of correctly discarding a non-conversing person.

Figure 7:
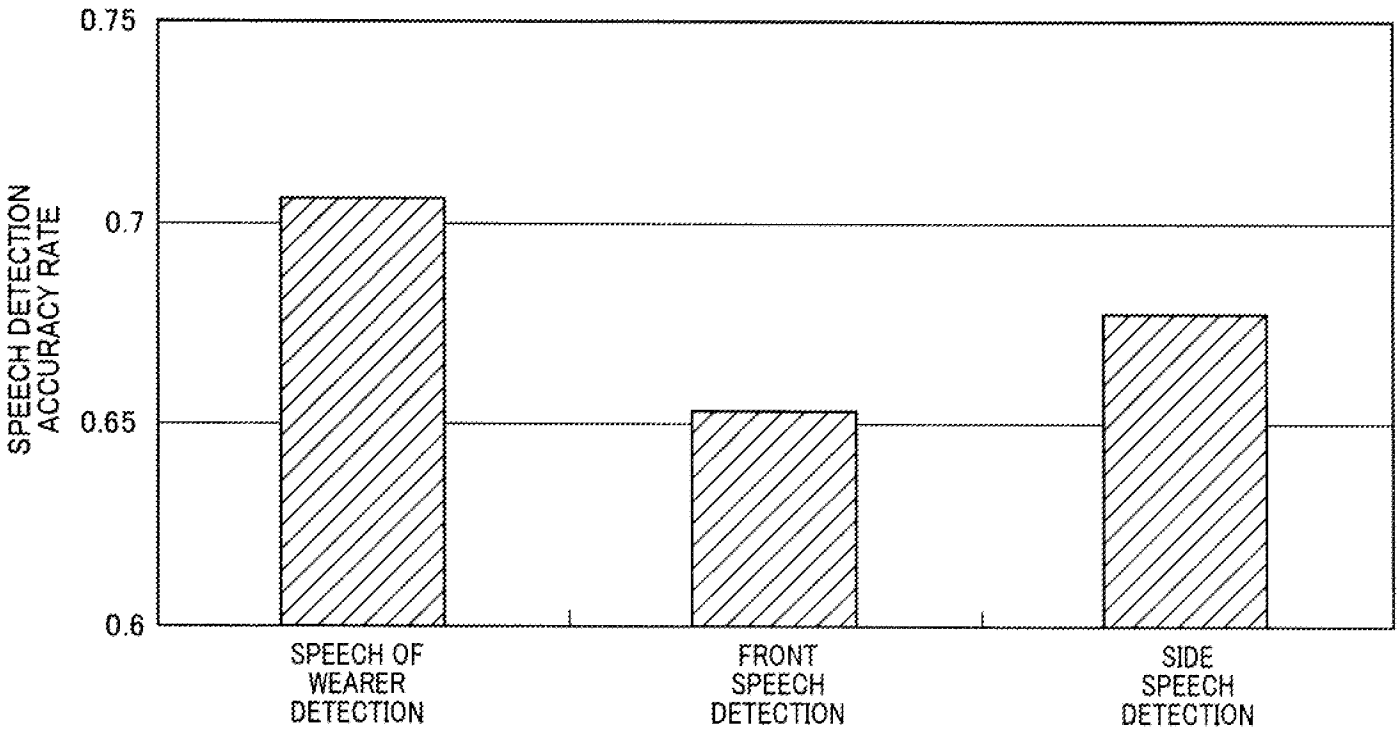
FIG. 7 is a figure illustrating, as a graph, a speech detection accuracy rate obtained by an evaluation experiment with the conversation detection apparatus according to Embodiment 1 above.
Figure 8:
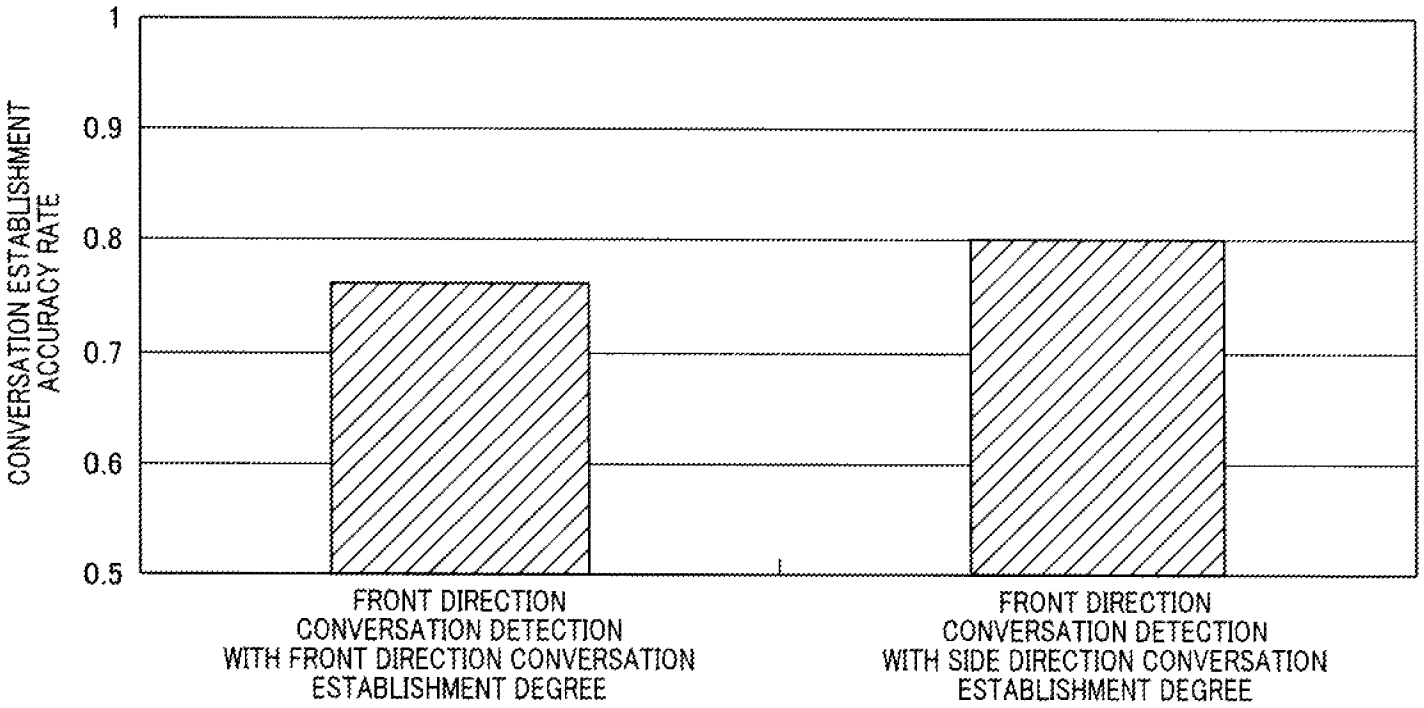
FIG. 8 is a figure illustrating, as a graph, a conversation detection accuracy rate obtained by an evaluation experiment with the conversation detection apparatus according to Embodiment 1 above.

FIGS. 7 and 8 are figures illustrating, as a graph, a speech detection accuracy rate and conversation detection accuracy rate according to this evaluation experiment.

First, FIG. 7 shows the speech detection accuracy rates of a detection result of speech of the wearer, a detection result of front speech, and a detection result of side speech.

As shown in FIG. 7, the speech of the wearer detection accuracy rate is 71%, the front speech detection accuracy rate is 65%, and the side speech detection accuracy rate is 68%. In other words, in this evaluation experiment, it is found that the following consideration is appropriate: the side speech is less likely to be affected by the speech of the wearer than the front speech and is advantageous in detection.

Subsequently, FIG. 8 shows an accuracy rate (average) of conversation detection with a front direction conversation establishment degree using detection results of the speech of the wearer and the front speech and an accuracy rate (average) of conversation detection with a side direction conversation establishment degree using detection results of the speech of the wearer and the side speech.

As shown in FIG. 8, the conversation detection accuracy rate with the front direction conversation establishment degree is 76%, whereas the conversation detection accuracy rate with the side direction conversation establishment degree is 80%, which is more than 76%. It other words, in this evaluation experiment, it is found that the advantage of the side speech detection is reflected in the advantage of the conversation detection with the side direction conversation establishment degree.

As can be understood from the above, as a result of this evaluation experiment, it is found that the use of the side speech detection is effective in the determination as to whether narrow directivity is given in front direction or not.

As described above, conversation detection apparatus 100 of the present embodiment includes self-speech detection section 102 for detecting the speech of the hearing aid wearer, front speech detection section 103 for detecting speech of a speaker in front of the hearing aid wearer as a speech in front direction, and side speech detection section 104 for detecting speech of a speaker residing at least one of right and left of the hearing aid wearer as a side speech. In addition, conversation detection apparatus 100 includes side direction conversation establishment degree deriving section 105 for calculating a conversation establishment degree between the speech of the wearer and the side speech based on detection results of the speech of the wearer and the side speech, front direction conversation detection section 106 for detecting presence/absence of conversation in front direction based on the detection result of the front speech and the calculation result of the side direction conversation establishment degree, and output sound control section 107 for controlling the directivity of speech to be heard by the hearing aid wearer based on the determined direction of the conversing person.

As described above, conversation detection apparatus 100 includes side direction conversation establishment degree deriving section 105 and front direction conversation detection section 106, and when the conversation establishment degree in side direction is low, it is estimated that conversation is held in front direction. This allows conversation detection apparatus 100 to accurately detect the conversation in front direction without being affected by the speech of the wearer.

In addition, this allows conversation detection apparatus 100 to detect presence/absence of speech in front direction without using the result of the conversation establishment degree calculation in front direction that is likely to be affected by the speech of the wearer. As a result, conversation detection apparatus 100 can accurately detect conversation in front direction without being affected by the speech of the wearer.

In the explanation about the present embodiment, output sound control section 107 switches wide directivity/narrow directivity according to the output converted into 0/1 by front direction conversation detection section 106, but the present embodiment is not limited thereto. Output sound control section 107 may form intermediate directivity based on the conversation establishment degree.

At this occasion, the side direction is any one of right and left. When it is determined that there are speakers at both sides, conversation detection apparatus 100 may be expanded to verify and determine each of them.

(Embodiment 2)

Figure 9:
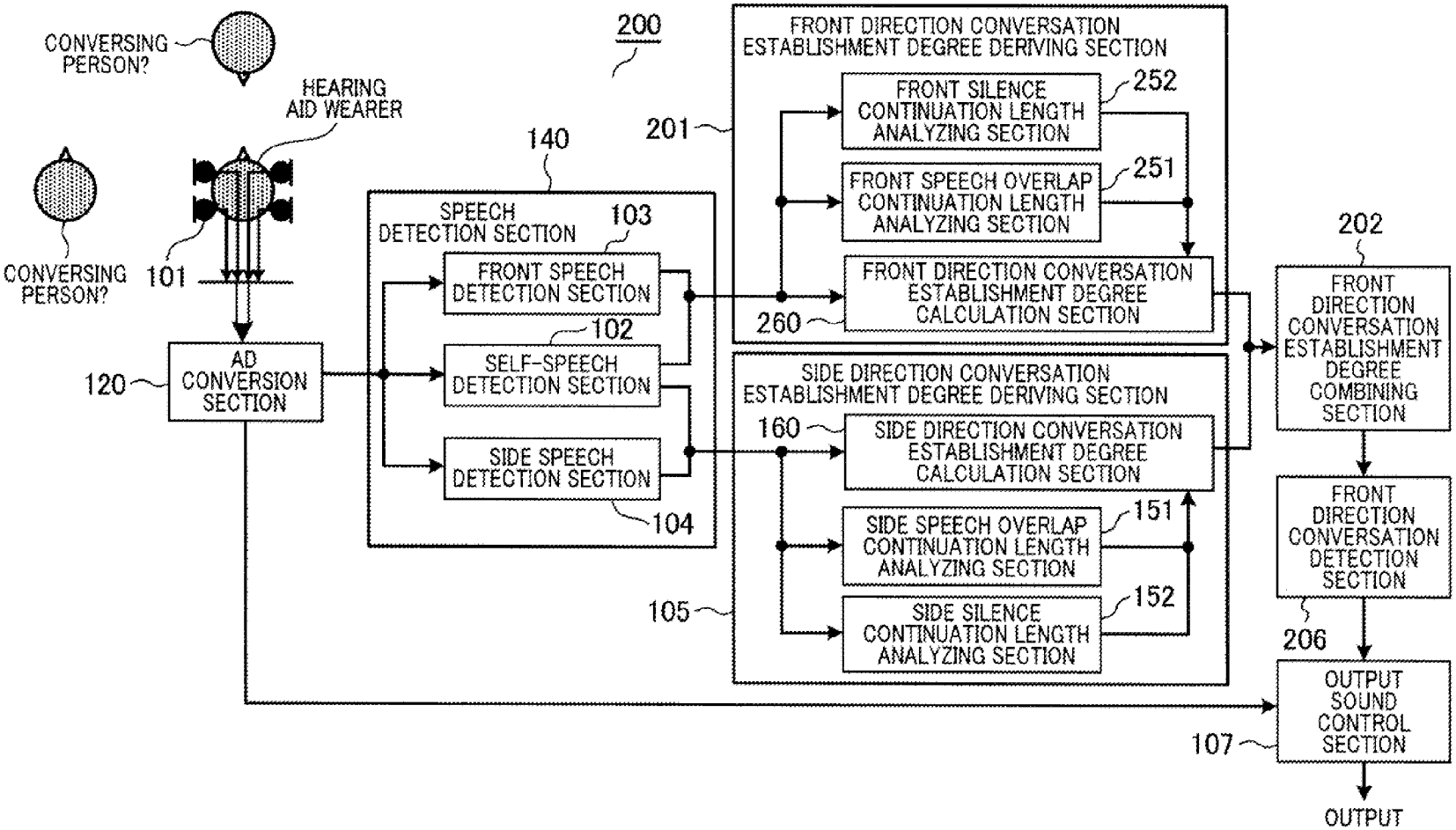
FIG. 9 is a figure illustrating a configuration of a conversation detection apparatus according to Embodiment 2 of the present invention.

FIG. 9 is a figure illustrating a configuration of a conversation detection apparatus according to Embodiment 2 of the present invention. The same constituent portions as those of FIG. 2 are denoted with the same reference numerals, and explanations about repeated portions are omitted.

As shown in FIG. 9, conversation detection apparatus 200 includes microphone array 101, self-speech detection section 102, front speech detection section 103, side speech detection section 104, side direction conversation establishment degree deriving section 105, front direction conversation establishment degree deriving section 201, front direction conversation establishment degree combining section 202, front direction conversation detection section 206, and output sound control section 107.

Front direction conversation establishment degree deriving section 201 receives the output of self-speech detection section 102 and the output of front speech detection section 103. Then, front direction conversation establishment degree deriving section 201 calculates a front direction conversation establishment degree representing the degree of conversation held between the hearing aid wearer and the speaker in front direction from time series of presence/absence of the speech of the wearer and the front speech.

Front direction conversation establishment degree deriving section 201 includes front speech overlap continuation length analyzing section 251, front silence continuation length analyzing section 252, and front direction conversation establishment degree calculation section 260.

Front speech overlap continuation length analyzing section 251 performs the same processing on the speech in front direction as the processing performed by side speech overlap continuation length analyzing section 151.

Front silence continuation length analyzing section 252 performs the same processing on the speech in front direction as the processing performed by side silence continuation length analyzing section 152.

Front direction conversation establishment degree calculation section 260 performs the same processing as the processing performed by side direction conversation establishment degree calculation section 160. Front direction conversation establishment degree calculation section 260 performs the processing based on the speech overlap continuation length analytical value calculated by front speech overlap continuation length analyzing section 251 and the silence continuation length analytical value calculated by front silence continuation length analyzing section 252. That is, front direction conversation establishment degree calculation section 260 calculates and outputs the conversation establishment degree in front direction.

Front direction conversation establishment degree combining section 202 combines the output of front direction conversation establishment degree deriving section 201 and the output of side direction conversation establishment degree deriving section 105. Further, front direction conversation establishment degree combining section 202 uses all the speech situations of the speech of the wearer, the front speech, and the side speech to output the degree at which conversation is held between the hearing aid wearer and the speaker in front direction.

Front direction conversation detection section 206 determines presence/absence of the conversation between the hearing aid wearer and the speaker in front direction with the threshold value processing based on the output of front direction conversation establishment degree combining section 202. When the front direction conversation establishment degree as the result of combining is high, front direction conversation detection 206 determines that conversation is held in front direction.

Output sound control section 107 controls the directivity of speech to be heard by the hearing aid wearer, based on the state of the conversation determined by front direction conversation detection section 206.

Basic configuration and operation of conversation detection apparatus 200 according to Embodiment 2 of the present invention are the same as those of Embodiment 1.

As stated in Embodiment 1, when the speech of the wearer is detected, and the front speech is detected, and the side speech is detected, then this means that there are all of the speech of the wearer, the front speech, and the side speech. Therefore, conversation detection apparatus 200 causes front direction conversation detection section 206 to detect presence/absence of conversation in front direction. Output sound control section 107 controls the directivity according to the detection result.

When there are speakers in front and at side, conversation detection apparatus 200 uses both of the chance of establishment of conversation in front direction and the chance of establishment of conversation in side direction to complement incomplete information, thus enhancing the accuracy of the conversation detection. More specifically, conversation detection apparatus 200 uses the subtraction value of the conversation establishment degree in front direction (conversation establishment degree based on the speech of the front speaker and the speech of the wearer) and the conversation establishment degree in side direction (conversation establishment degree based on the speech of the speaker in side direction and the speech of the wearer) to calculate the conversation establishment degree combined in front direction.

In the combined conversation establishment degree, the signs of the two original conversation establishment degrees are different based on the assumption that one of the speaker in front direction and the speaker in side direction is a conversing person. For this reason, in the conversation establishment degree in front direction, these two conversation establishment degree values enhance each other. That is, when there is a conversing person in front, the combined value is large, and when there is no conversing person in front, the combined value is small.

Based on such consideration, front direction conversation establishment degree combining section 202 combines the output of front direction conversation establishment degree deriving section 201 and the output of side direction conversation establishment degree deriving section 105.

When the conversation establishment degree combined in front direction is high, front direction conversation detection section 206 determines that there is conversation between the hearing aid wearer and the speaker in front direction.

According to such configuration, when the conversation establishment degree combined in front direction and in side direction is high, front direction conversation detection section 206 determines that there is conversation between the hearing aid wearer and the speaker in front direction. This allows front direction conversation detection section 206 to detect conversation in front direction by compensating the accuracy of a single conversation establishment degree in front direction in which high level of accuracy cannot be obtained due to the influence of the speech of the wearer.

The inventors of the present invention actually recorded everyday conversation and conducted evaluation experiment of conversation detection. Subsequently, a result of this evaluation experiment will be explained.

The data are the same as those of Embodiment 1, and the speech detection accuracy rates of the speech of the wearer, the front speech, and the side speech are also the same.

Figure 10A:
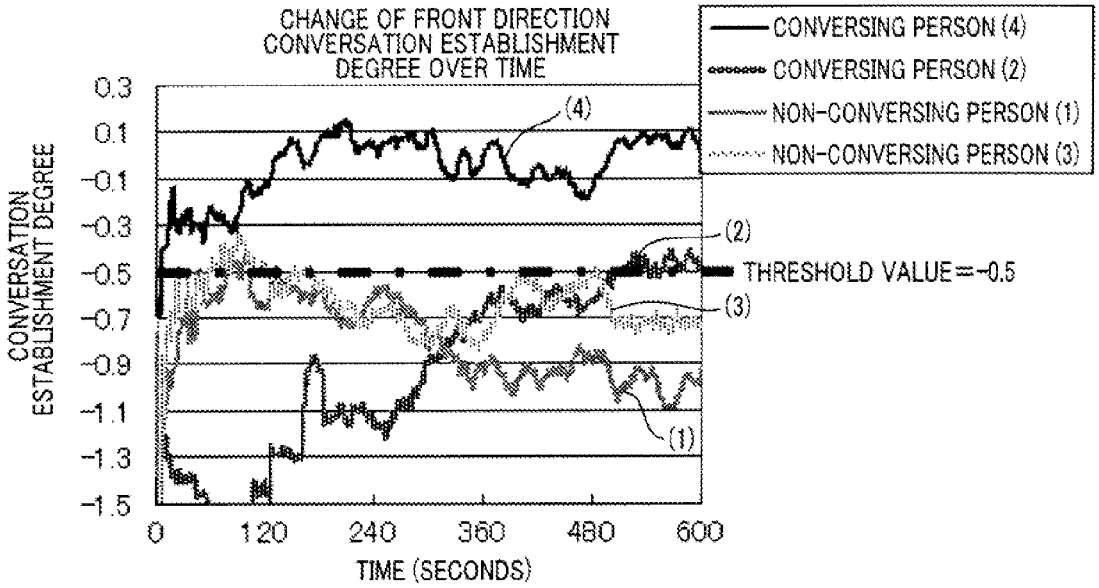
FIGS. 10A and 10B are figures illustrating an example of change of a conversation establishment degree over time in the conversation detection apparatus according to Embodiment 2 above.
Figure 10B:
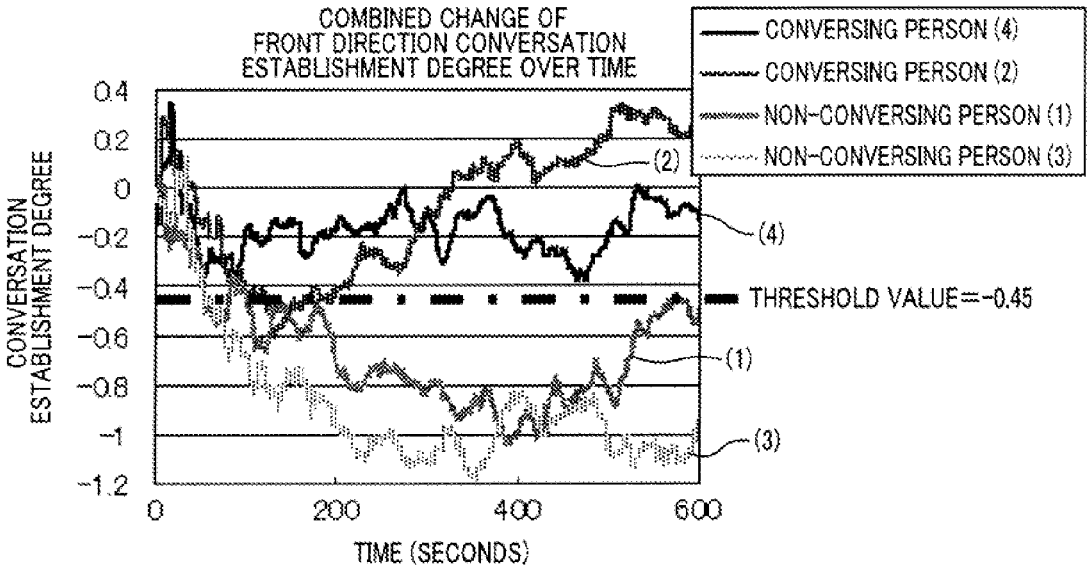

FIG. 10 illustrates an example of change of a conversation establishment degree over time. FIG. 10A shows a case of a conversation establishment degree in front direction alone. FIG. 10B shows a case of a combined conversation establishment degree.

In FIGS. 10A and 10B, data in (1) and (3) are obtained when conversation is held side by side, and data in (2) and (4) are obtained when conversation is held face to face.

In FIGS. 10A and 10B, in this evaluation experiment, a threshold value θ is set so as to divide a case where the speaker in front is a conversing person (see (2) and (4)) and a case where the front speaker in front is a non-conversing person (see (1) and (3)). As shown in FIG. 10A, in the example of this evaluation experiment, when θ is set at −0.5, the cases can be divided relatively well, but in the above case (2), the conversation establishment degree does not increase, which makes it difficult to separate a conversing person and a non-conversing person. As shown in FIG. 10B, in the example of this evaluation experiment, when θ is set at −0.45, the cases, can be divided relatively well. When the evaluation experiments of FIGS. 10A and 10B are compared, the separation with the threshold value can be separated extremely well in the case of FIG. 10B.

Figure 11:
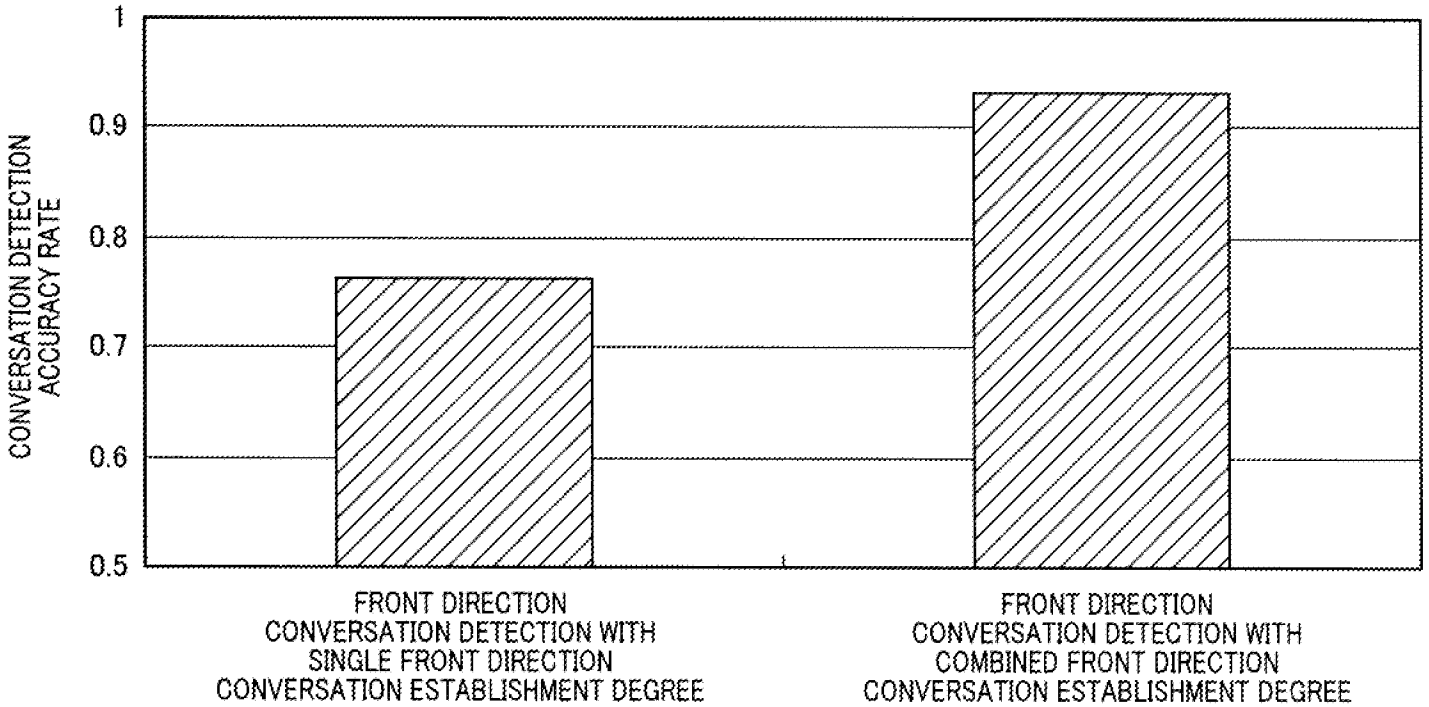
FIG. 11 is a figure illustrating, as a graph, a conversation detection accuracy rate obtained by an evaluation experiment with the conversation detection apparatus according to Embodiment 2 above.

FIG. 11 is illustrates, as a graph, a conversation detection accuracy rate obtained by an evaluation experiment.

FIG. 11 illustrates an accuracy rate (average) of conversation detection with a single front direction conversation establishment degree using detection results of the speech of the wearer and the front speech. FIG. 11 illustrates an accuracy rate (average) of conversation detection with a single front direction conversation establishment degree obtained by combining a single front direction conversation establishment degree using detection results of the speech of the wearer and the front speech and a side direction conversation establishment degree using detection results of the speech of the wearer and the side speech.

As shown in FIG. 11, in this evaluation experiment, the conversation detection accuracy rate with the single front direction conversation establishment degree is 76%, whereas the conversation detection accuracy rate with the combined front direction conversation establishment degree is 93%, which is more than 76%. In other words, this evaluation experiment indicates that the accuracy can be enhanced by using the side speech detection.

As can be understood from the above, in the present embodiment, the use of the side speech detection is effective in the determination as to whether narrow directivity is given in front direction or not.

The above explanations are examples of preferred embodiments of the present invention, and the scope of the present invention is not limited thereto.

For example, in the above explanation about the embodiments, the present invention is applied to the hearing aid using the wearable microphone array. However, the present invention is not limited thereto. The present invention can be applied to a speech recorder and the like using a wearable microphone array. In addition, the present invention can also be applied to a digital still camera/movie and the like having a microphone array mounted thereon used in proximity to the head portion (which is affected by the speech of the wearer). In digital recording apparatuses such as a speech recorder, a digital still camera/movie, and the like, interference sound such as conversations of people other than a conversation to be subjected to determination can be suppressed, and a desired conversation can be reproduced by extracting a conversation of a combination in which the conversation establishment degree is high. Processing of suppression and extraction can be executed online or offline.

In the present embodiment, names such as the conversation detection apparatus, the hearing aid, and the conversation detection method are used. However, such names are for the sake of convenience of explanation. The apparatus may be a conversing person extraction apparatus and a speech signal processing apparatus, and the method may be a conversing person determination method and the like.

The conversation detection method explained above is also achieved with a program for allowing this conversation detection method to function (that is, program for causing a computer to execute each step of the conversation detection method). This program is stored in a computer-readable recording medium.

The disclosure of Japanese Patent Application No. 2010-149435 filed on Jun. 30, 2010, including the specification, drawings and abstract, is incorporated herein by reference in its entirety.

INDUSTRIAL APPLICABILITY

The conversation detection apparatus, the hearing aid, and the conversation detection method according to the present invention are useful as a hearing aid and the like having a wearable microphone array. The conversation detection apparatus, the hearing aid, and the conversation detection method according to the present invention can also be applied to purposes such as a life log and an activity monitor. Further, the conversation detection apparatus, the hearing aid, and the conversation detection method according to the present invention are useful as a signal processing apparatus and signal processing method in various fields such as a speech recorder, a digital still camera/movie, and a telephone conference system.

REFERENCE SIGNS LIST

100, 200 conversation detection apparatus
101 microphone array
102 self-speech detection section
103 front speech detection section
104 side speech detection section
105 side direction conversation establishment degree deriving section
106, 206 front direction conversation detection section
107 output sound control section
151 side speech overlap continuation length analyzing section
152 side silence continuation length analyzing section
160 side direction conversation establishment degree calculation section
120 A/D conversion section
201 front direction conversation establishment degree deriving section
202 front direction conversation establishment degree combining section
251 front speech overlap continuation length analyzing section
252 front silence continuation length analyzing section
260 front direction conversation establishment degree calculation Section

The invention claimed is:

1. A conversation detection apparatus including a microphone array having at least two or more microphones per one side attached to at least one of right and left sides of a head portion, the conversation detection apparatus using the microphone array to determine whether a speaker in front is a conversing person or not, the conversation detection apparatus comprising:

a hardware processor; and a non-transitory memory storing instructions thereon, which when executed by the processor, cause the processor to perform:

detecting a first speech indicating speech of a front speaker in front of the microphone array wearer;

detecting a second speech indicating speech of the microphone array wearer;

detecting a third speech indicating speech of a side speaker residing at at least one of right and left of the microphone array wearer;

calculating, by using detection results of the second speech and the third speech, one of (i) a first feature value indicating an average time length per period when both the second speech and the third speech are detected and (ii) a second feature value indicating an average time length per period when both the second speech and the third speech are not detected;

calculating, by using the calculated one of the first feature value and the second feature value, a side direction conversation establishment degree, the side direction conversation establishment degree having a negative relationship with the first feature value and having a negative relationship with the second feature value; and determining whether conversation between the microphone wearer and the front speaker is present or absent by using the detection results of the first speech and the side direction conversation establishment degree, wherein the conversation between the microphone wearer and the front speaker is determined to be present when the first speech is detected and the side direction conversation establishment degree is less than a predetermined value.

2. The conversation detection apparatus according to claim 1, wherein the second speech is detected by extraction of a vibration component.

3. The conversation detection apparatus according to claim 1, wherein the instructions, when executed by the processor, further cause the processor to perform correcting power information in a side direction based on power information for detecting the second speech.

4. A hearing aid comprising: the conversation detection apparatus according to claim 1; and an output sound controller that controls directivity of speech to be heard by the microphone array wearer, based on the determined conversing person direction.

5. A conversation detection method using a microphone array having at least two or more microphones per one side attached to at least one of right and left sides of a head portion to determine whether a speaker in front is a conversing person or not, the conversation detection method comprising the steps of:

detecting a first speech indicating a speech of a speaker in front of the microphone array wearer;

detecting a second speech indicating a speech of the microphone array wearer;

detecting a third speech indicating a speech of a speaker residing at at least one of right and left of the microphone array wearer;

calculating, by using detection results of the second speech and the third speech, one of (i) a first feature value indicating an average time length per period when both the second speech and the third speech are detected and (ii) a second feature value indicating an average time length per period when both the second speech and the third speech are not detected;

calculating, by using the calculated one of the first feature value and the second feature value, a side direction conversation establishment degree, the side direction conversation establishment degree having a negative relationship with the first feature value and having a negative relationship with the second feature value; and determining whether conversation between the microphone wearer and the front speaker is present or absent by using the result of the detection results of the first speech and the side direction conversation establishment degree, wherein the conversation between the microphone wearer and the front speaker is determined to be present when the first speech is detected and the side direction conversation establishment degree is less than a predetermined value.

6. The conversation detection apparatus including a microphone array having at least two or more microphones per one side attached to at least one of right and left sides of a head portion, the conversation detection apparatus using the microphone array to determine whether a speaker in front is a conversing person or not, the conversation detection apparatus comprising:

a hardware processor; and a non-transitory memory storing instructions thereon, which when executed by the processor, cause the processor to perform:

detecting a first speech indicating a speech of a front speaker in front of the microphone array wearer;

detecting a second speech indicating a speech of the microphone array wearer;

detecting a third speech indicating a speech of a side speaker residing at least one of right and left of the microphone array wearer;

calculating, by using detection results of the second speech and the third speech, one of (i) a first feature value indicating an average time length per period when both the second speech and the third speech are detected and (ii) a second feature value indicating an average time length per period when both the second speech and the third speech are not detected;

calculating, by using the calculated one of the first feature value and the second feature value, a side direction conversation establishment degree, the side direction conversation establishment degree having a negative relationship with the first feature value and having a negative relationship with the second feature value;

calculating, by using detection results of the first speech and the second speech, at least one of (i) a third feature value indicating an average time length per period when both the first speech and the second speech are detected and (ii) a fourth feature value indicating an average time length of per period when both the third speech and the forth speech are not detected;

calculating, by using the calculated one of the third feature value and the fourth feature value, a front direction conversation establishment degree, the front direction conversation establishment degree having a negative relationship with the third feature value and having a negative relationship with the fourth feature value;

calculating a combined conversation establishment degree by using the side direction conversation establishment degree and the front direction conversation establishment degree; and determining whether conversation between the microphone wearer and the front speaker is present when the combined conversation establishment degree is larger than a predetermined value.

7. The conversation detection apparatus according to claim 6, wherein the combined conversation establishment degree is calculated by subtracting the front direction conversation establishment degree from the side direction conversation establishment degree.

* * * * *